United States Patent [19]

Das et al.

[11] 4,046,558

[45] Sept. 6, 1977

[54] METHOD FOR THE PRODUCTION OF ALUMINUM-SILICON ALLOYS

[75] Inventors: Subodh K. Das, Natrona Heights; Richard A. Milito, Natrona, both of Pa.

[73] Assignee: Aluminum Company of America, Pittsburgh, Pa.

[21] Appl. No.: 744,154

[22] Filed: Nov. 22, 1976

[51] Int. Cl.[2] ..... C22B 21/02

[52] U.S. Cl. ..... 75/68 A; 75/10 A

[58] Field of Search ..... 75/10 R, 68 R, 68 A

[56] References Cited

U.S. PATENT DOCUMENTS

| | | | |
|---|---|---|---|
| 3,254,988 | 6/1966 | Schmidt et al. | 75/68 R |
| 3,257,199 | 6/1966 | Schmidt | 75/68 R |
| 3,615,347 | 10/1971 | Schmidt et al. | 75/10 R |
| 3,655,362 | 4/1972 | Schmidt et al. | 75/68 A |
| 3,661,561 | 5/1972 | Frey et al. | 75/68 A |
| 3,661,562 | 5/1972 | Seth | 75/68 A |
| 3,758,289 | 9/1973 | Wood | 75/10 R |
| 3,892,558 | 7/1975 | Ilinkov et al. | 75/10 R |

*Primary Examiner*—M. J. Andrews
*Attorney, Agent, or Firm*—Andrew Alexander

[57] ABSTRACT

A method of producing an aluminum-silicon type alloy from alumina-silica bearing materials comprises providing the silica and alumina bearing materials in a mix having a weight ratio of silica to alumina in the range of 0.5 to 1.1. The method further comprises providing a source of carbonaceous material in the mix and carbothermically reducing it to form the aluminum-silicon alloy.

14 Claims, 1 Drawing Figure

METHOD FOR THE PRODUCTION OF ALUMINUM-SILICON ALLOYS

INTRODUCTION

This invention relates to aluminum-silicon alloys and more particularly it relates to the carbothermic production of aluminum-silicon alloys.

Conventionally, aluminum-silicon alloys are prepared by forming commercially pure aluminum in an electrolytic cell using alumina derived from bauxite and adding to the aluminum so formed relatively pure silicon prepared independently. However, this normally results in an expensive method of making the aluminum-silicon alloy.

Because of the concern over the availability of bauxite and its escalating cost, considerable research effort has been expended on developing more economical methods for the production of aluminum, particularly aluminum-silicon alloys, from other sources. In the prior art it is known that aluminum-silicon alloys can be made from naturally occurring alumina-silica containing ore by the addition of carbon thereto and carbothermically reducing such mixture in a furnace. For example, Seth et al disclose in U.S. Pat. No. 3,661,562 that aluminum-silicon alloys can be produced in a blast furnace from alumina-silica ores. However, it is preferred that the ores used contain 50 to 70 percent or more alumina. The availability of such alumina rich ore is quite limited, resulting in a relatively high priced product. Also, in the prior art, Ilinkov et al in U.S. Pat. No. 3,892,558 disclose a briquette composition for producing aluminum-silicon alloys in an electric-arc furnace. The briquette contains a carbonaceous reducing agent, kaolin, alumina and disthene sillimanite. According to the patent, this briquette composition enhances sintering of the charge on top of the ore heat-treating furnace and aids in running the furnace without the formation of air holes and falling-ins of the charge. However, because alumina has to be provided and because reduction is performed in an electric-arc furnace, the process also results in an uneconomical method of making aluminum-silicon alloys.

Compared to the production of aluminum from ores having a high alumina content, the carbothermic production of aluminum from alumina-silica containing ores having a relatively low alumina content, for example, anorthosite, has proven to be quite difficult and usually results in very poor yields when conventional methods are used. However, such ores, e.g. anorthosite, even though low in alumina, constitute the most abundant sources of aluminum. Thus, there is a great need for a process which will extract aluminum from such low grade ores in a highly economical manner. The present invention fulfills this need by providing a highly economical process which can be used for the production of aluminum from materials having a low alumina content.

SUMMARY OF THE INVENTION

An object of this invention is the production of aluminum-silicon alloys from alumina and silica bearing materials.

Another object of this invention is the production of aluminum-silicon alloys from ores containing alumina and silica.

A further object of this invention is the carbothermic production of aluminum-silicon alloys from ores having a low alumina content.

Further objects of this invention will become apparent from the drawing, description and claims appended hereto.

In accordance with these objects there is provided a method of forming an aluminum-silicon alloy from alumina-silica bearing materials. The method comprises providing or maintaining the silica and alumina bearing materials in a mix having a weight ratio of silica to alumina in the range of 0.5 to 1.1. In addition, the method comprises providing a source of carbonaceous material in the mix and carbothermically reducing it in a furnace to provide the aluminum-silicon alloy. In a preferred embodiment of the invention, the alumina-silica ratio can be adjusted by the addition of bauxite. In another embodiment the ratio may be adjusted by the removal or addition of silica.

DETAILED DESCRIPTION OF THE PREFERRED EMBODIMENTS

Figure 1:
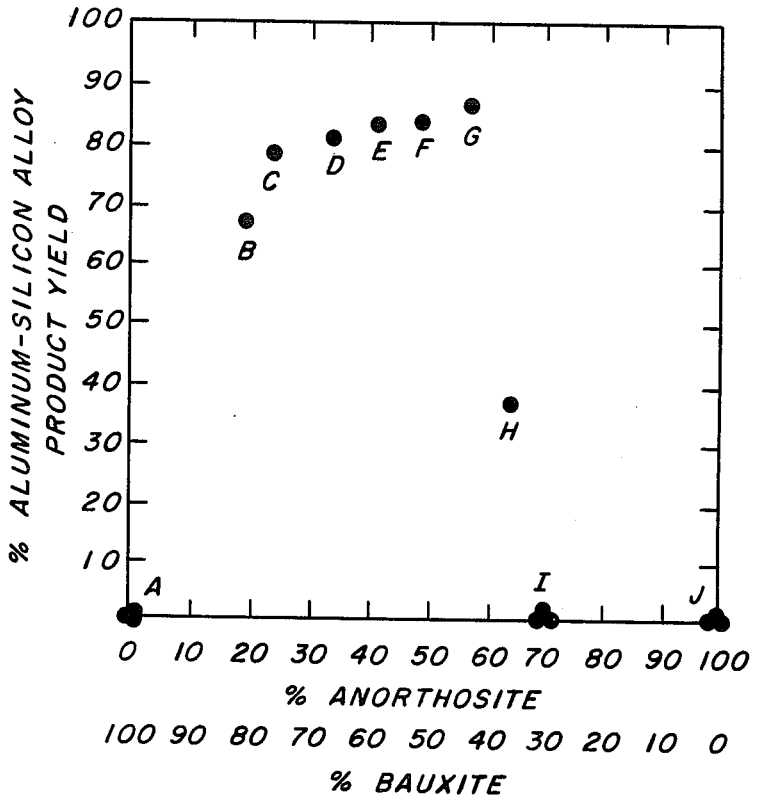
FIG. 1 is a chart illustrating the yield of aluminum-silicon alloy product resulting from combinations of anorthosite (25 wt.% alumina and 55 wt.% silica) and bauxite (50 wt.% alumina and 2 wt.% silica) when reduced in accordance with the process of the invention.

In accordance with the present invention, aluminum-silicon alloys can be prepared from alumina-silica bearing materials such as ores, for example, by providing the ore in a mix having a weight ratio of silica to alumina in the range of 0.5 to 1.1, providing in the mix a carbonaceous material and carbothermically reducing the mix to form the aluminum-silicon alloy. Alumina and silica bearing materials referred to include ores such as anorthosite, nepheline, dawsonite, bauxite, laterite and shale. Other materials which can be used as a source of alumina include ash and coal refuse. The alumina-silica bearing materials referred to and other materials useful in the invention are tabulated below along with typical composition ranges in weight percent:

TABLE I

ALUMINOUS RAW MATERIALS - RANGES OF CHEMICAL COMPOSITION (wt. %)

| Raw Material | $Al_2O_3$ | $SiO_2$ | $Fe_2O_3$ | $TiO_2$ | CaO | MgO | $Na_2O$ | $K_2O$ |
|---|---|---|---|---|---|---|---|---|
| Anorthosite (Average) | 16.1-32.72 (25.72) | 45.78-60.7 (54.54) | 0.15-9.90 (0.83) | 0.02-3.21 (0.52) | 5.0-18.72 (9.62) | 0.02-6.43 (0.83) | 0.68-7.1 (4.66) | 0.03-3.1 (1.06) |
| Nepheline Bearing Rocks (Average) | 12.4-27.10 (21.30) | 38.35-60.03 (55.38) | 1.54-8.64 (2.42) | 0.40-2.6 (0.66) | 0.36-19.94 (1.98) | 0.22-5.99 (0.57) | 3.72-9.72 (8.84) | 0.25-9.54 (5.34) |
| Leucite Bearing Rocks (Average) | 7.90-20.29 (16.05) | 39.28-51.93 (47.05) | 3.17-7.59 (3.49) | 0.20-4.29 (1.54) | 1.65-12.36 (10.80) | 0.22-17.58 (6.20) | 0.90-8.49 (2.35) | 4.98-9.81 (5.38) |
| Alumitized Rocks | 17.58-29.45 | 0.22-65.80 | 0.02-10.37 | 0.05-3.80 | 0.05-0.26 | 0.01-1.0 | 0.16-4.72 | 0.71-10.46 |
| Dawsonite Bearing Rocks | 9.78-13.81 | 35.1-53.3 | 3.67-4.82 | | 14.8-33.9 | 7.0-13.43 | 1.6-4.4 | 1.6-4.5 |
| $AlPO_4$ Bearing | 5.98-14.9 | 40.92-69.46 | 1.32-2.86 | 0.31-0.65 | 0.20-8.98 | 0.01- | 0.03-0.23 | 0.00- |

TABLE I-continued

| ALUMINOUS RAW MATERIALS - RANGES OF CHEMICAL COMPOSITION (wt. %) | | | | | | | | |
|---|---|---|---|---|---|---|---|---|
| Raw Material | $Al_2O_3$ | $SiO_2$ | $Fe_2O_3$ | $TiO_2$ | CaO | MgO | $Na_2O$ | $K_2O$ |
| Rocks | | | | | | | | |
| Bauxite | 33.15–61.51 | 0.43–38.60 | 0.96–28.90 | 0.67–4.08 | 0.00–6.7 | 0.00–0.34 | 0.00–0.16 | 0.00–0.34 |
| Laterites | 15.1–44.1 | 2.25–68.0 | 3.8–60.00 | 0.16–6.40 | 0.47–2.80 | 0.23–1.66 | | |
| Hi-Alumina Shales | 11.36–39.50 | 45.60–78.63 | 0.67–6.74 | 0.50–0.93 | 0.10–8.90 | 0.84–3.52 | 0.11–1.92 | 2.21–5.0 |
| Coal Waste-Ash Analysis | 8.0–38.2 | 15.0–68.7 | 1.30–56.3 | 0.5–4.7 | <0.02–36.0 | 0.2–10.8 | 0.1–8.2 | 0.1–4.7 |
| Coal and Lignite Fly Ash | 2.2–36.3 | 4.8–68.7 | 1.9–36.3 | 0.56–1.09 | 2.54–49.81 | 0.2–25.5 | 0.2–9.0 | 0.2–1.42 |

It will be noted that materials such as anorthosite, nepheline, leucite and dawsonite, have substantial amounts of CaO, MgO, $Na_2O$ and $K_2O$ present. It should also be noted that anorthosite which comprises a mixture of anorthite ($CaOAl_2O_32SiO_2$) and albite ($NaAlSi_3O_8$) is a preferred source of alumina in the present invention.

In preparing an ore, for example, for use in the present invention, it should be ground to a mesh size in the range of −14 to −200 (Tyler Series) with a preferred range being −28 to −100 (Tyler Series). Prior to the alumina-silica bearing material being adjusted within the weight ratio noted above, it is preferred that such material be subjected to initial beneficiation or mechanical separation such as a flotation process or heavy media or magnetic separation for purification purposes. When the ore is anorthosite, for example, it is preferred that it be subjected to a hydrochloric acid purification treatment to remove calcium oxide (CaO) and sodium oxide ($Na_2O$) and the like. For such treatment, the hydrochloric acid should have a concentration in the range of 5 to 20 wt.% and the temperature should be in the range of 60° to 100° C. A typical time for such treatment is in the range of ½ to 3 hours. After such treatment the ore may be washed with water.

In order to effect economic carbothermic reduction of the alumina-silica bearing material and thus produce a high yield of aluminum-silicon alloy, the silica-alumina content of the material as expressed by weight ratio must fall within the range of 0.5 to 1.1 and preferably in the range of 0.7 to 1.0, with a highly suitable ratio being about 0.9. The ratio of 0.7 to 1.0 is preferred for several reasons. With a ratio lower than 0.7 there is a tendency to form aluminum carbide which lowers the overall yield. Also, with higher ratios, i.e. with greater amounts of silica present, the amount of adjusting to provide the ore in the preferred ratio range is greatly diminished, particularly in the case where the silica content is high, as in low grade alumina ores. That is, the higher silica to alumina ratios are much more favorable from an economic standpoint. Also, the higher ratios provide higher product yields.

For materials low in alumina, e.g. anorthosite, or low in silica, e.g. bauxite, the silica-alumina ratio can be adjusted to fall within the weight ratio range referred to above. Materials low in alumina as referred to herein are those typified by having an alumina content less than 35 wt.% and typically having an alumina content in the range of 8 to 35 wt.%. Such low alumina containing materials normally have silica present from 25 to 65 Wt.%. If anorthosite, having silica to alumina ratio of about 2.15, is used as a starting material, this ratio can be adjusted into the range referred to by the addition of an alumina rich ore, i.e. preferably low in silica, for example bauxite. The bauxite used for such adjustment should preferably contain not less than 35 wt.% alumina. Further, preferably, the bauxite should contain alumina in the range of 40 to 55 wt.% and silica in the range of 0.1 to 15 wt.%. It is also preferred to have substantial amounts of iron oxide present either in the material used for adjusting, e.g. bauxite, or in the starting material. Typically, iron oxide can be present in the range of 0.5 to 30 wt.%. The presence of iron oxide results in iron being present in the alloy which is believed to lower the volatility of the alloy as it is produced, consequently resulting in higher product yields. Purified forms of materials rich in alumina, e.g. bauxite, can also be used but on a much less preferred basis because of the extra steps and expense involved in purifying and because the yield obtained is normally lower.

Another method of adjusting the ratio within the range referred to includes removing the silica as by physical beneficiation or by leaching. For example, alpha quartz constituting a large percentage of the silica in anorthosite can be removed to a degree which minimizes its effect by treating the ore with hydrofluoric acid. For purposes of removing the silica, the hydrofluoric acid should be in the range of 1 to 10 wt.%. The temperature of the leaching solution, as in the hydrochloric acid treatment, should be in the range of 60° to 100° C and the time of leaching should be in the range of ½ to 3 hours. In employing hydrofluoric acid to leach anorthosite, the silica to alumina weight ratio can be lowered from 2.2 to 1.4 by a 10 wt.% HF solution at 100° C for 1 hour. Thus, the amount of alumina rich ore which may be required to provide the desired ratio is lowered significantly. The acid leaching step to remove silica can be combined with the prior leaching step to remove alkali and alkaline earth metal oxides.

With respect to shale or fly ash, the silica content therein can be lowered by leaching with hydrofluoric acid, for example, to provide the desired silica to alumina ratio. It will be noted that the higher ratios are very favorable with respect to leaching of silica since the extent of leaching is significantly diminished.

In yet another method of providing silica-alumina in the weight ratio referred to above, silica can be added. For example, if bauxite, having a silica-alumina weight ratio in the range of 0.02 to 0.05, is used as the alumina-silica bearing material, a source of silica can be added to provide the desired weight ratio.

It will be appreciated that a combination of these steps for adjusting the silica-alumina weight ratio may be employed. That is, the ore, for example, can be partially leached to remove silica and thereafter bauxite can be added to the partially leached ore in order to bring it within the silica-alumina weight ratio range.

For purposes of reduction, a mix containing the silica-alumina in the desired ratio and carbonaceous material should be provided. Such mix should contain 15 to 30 wt.% carbonaceous material based on the carbon content of the material with a preferred amount being 19 to 28 wt.%. When alumina-silica bearing materials such as shale are used, a certain amount of carbonaceous material can be present in the shale, thus the amount of reducing material to be added is lowered. The carbonaceous material referred to includes coke, a preferred source of which is metallurgical coke, since it has a high porosity which favors the reduction reaction.

The mix, which preferably is formed into briquettes, can be reduced in a blast furnace or electric furnace, with the blast furnace technique being preferred because of economics. Thus, for purposes of reduction and heating in a blast furnace the mix should contain 55 to 90 wt.% carbon. That is, in addition to the carbonaceous material provided for reduction, 40 to 60 wt.% carbonaceous material should be provided for heating purposes in the blast furnace.

When the alumina-silica bearing material is oil shale, it is preferred to remove materials such as volatile hydrocarbons. Thus, prior to adjusting the silica-alumina ratio, it is preferred to treat the shale to remove such materials. Such treatments can include physical or chemical beneficiation and carbonization to remove the volatiles and to coke the carbonaceous material therein. The presence of coke already in the shale, as noted above, reduces the amount of reducing material to be added.

Thus, it can be seen that the present invention is highly advantageous since it permits the use of low grade alumina ore for the economic production of aluminum. In addition, the present invention is advantageous in that it does not require additions of materials such as elemental silicon or metals such as iron, or intermetallic complexes or alloys containing such materials. That is, the charge or feed to the furnace may be free of such materials and yet high yields of aluminum product can be obtained in accordance with the invention.

The following examples are still further illustrative of the invention.

EXAMPLE 1

Anorthosite containing 25% alumina and 55% silica and bauxite containing 49.8% alumina, 1.67% silica, 15.8% iron oxide ($Fe_2O_3$), both of which were ground to a mesh size of −28 (Tyler Series), were combined with petroleum coke ground to −100 mesh, (Tyler Series). The anorthosite and bauxite were combined in amounts to provide mixtures having silica-alumina in a ratio as tabulated below. Each mixture was heated in an electric furnace from about room temperature to about 2100° C over a period of 6 hours with heat being added constantly. The amount of aluminum alloy product and yield obtained from each of the mixtures are also tabulated below.

TABLE II

| Experiment | Anorthosite (gms) | Bauxite (gms) | Carbon (gms) | Weight Ratio Silica to Alumina | Aluminum-Silicon Alloy Product (gms) | % Yield |
|---|---|---|---|---|---|---|
| A | 0 | 500.0 | 114.5 | 0.033 | 0 | 0 |
| B | 100.0 | 434.0 | 132.1 | 0.26 | 105.0 | 67 |
| C | 100.0 | 326.0 | 116.6 | 0.32 | 101.0 | 79 |
| D | 150.0 | 300.0 | 123.3 | 0.47 | 110.0 | 81 |
| E | 200.0 | 290.0 | 143.0 | 0.59 | 130.0 | 83 |
| F | 200.0 | 212.0 | 131.2 | 0.73 | 112.0 | 83 |
| G | 300.0 | 225.0 | 141.0 | 0.91 | 154.0 | 87 |
| H | 300.0 | 171.6 | 173.1 | 1.05 | 60.0 | 37 |
| I | 300.0 | 129.0 | 163.0 | 1.21 | 0 | 0 |
| J | 500.0 | 0 | 167.0 | 2.19 | 0 | 0 |

In FIG. 1, the percent aluminum-silicon alloy product yield set forth in Table II is plotted against the corresponding mixes of anorthosite and bauxite. The yield shown is based on an aluminum-silicon alloy product obtained from alumina and silica present in the mixture charged to the furnace.

It can be seen from the results of these tests that the silica-alumina weight ratio of the anorthosite or of the bauxite having the above compositions has to be adjusted in order to effect production of the aluminum alloy product. That is, when either the anorthosite or bauxite having the above compositions was used without adjustment of the silica-alumina ratio, substantially no alloy product was obtained.

EXAMPLE 2

In this example, an Al-Si-Fe alloy was produced from Chattanooga oil shale. 200 gms of carbonized shale (−28 mesh), which contained 66% $SiO_2$, 14% $Al_2O_3$, 12% $Fe_2O_3$ and 11% C, was mixed with 200 gms bauxite and 87 gms coke. The silica-alumina weight ratio was 0.89. This mixture was heated to about 2100° C as in Example 1 and 97 gms of alloy product or an 83% yield was obtained.

EXAMPLE 3

400 gms bauxite (−28 mesh) having the composition as in Example 1 was combined with 169 gms silica (−140 mesh) providing a silica to alumina weight ratio of 0.88. To this was added 161 gms petroleum coke (−100 mesh). This mix was heated to a temperature of 2100° C as in Example 1, and 162 gms of aluminum alloy product was obtained. This corresponds to a yield of 86%.

EXAMPLE 4

To 300 grams of fly ash (−28 mesh) having an alumina content of 16.8 wt.% and a silica content of 39.4 wt.% was added 165.3 gms bauxite having a composition as in Example 1. To this was added 86.1 grams of petroleum coke (−100 mesh). This mix was heated to a temperature of about 2100° C as in Example 1. This test produced 91.5 gms of alloy product or a 75% yield.

It can be seen from these examples that aluminum-silicon type alloys can be produced from various grades of ores once the silica and alumina have been provided in a ratio in accordance with the invention.

While the invention has been described in terms of preferred embodiments, the claims appended hereto are intended to encompass other embodiments which fall within the spirit of the invention.

Having thus described the invention and certain embodiments thereof, we claim:

1. A method of carbothermically reducing alumina and silica bearing materials to produce aluminum-silicon alloys comprising:

a. providing alumina and silica bearing materials in a mix having a weight ratio of silica to alumina in the range of 0.5 to 1.1;

b. providing in said mix a source of carbonaceous material for effecting reduction of said alumina and silica in said mix; and c. carbothermically reducing alumina and silica contents of said mix to produce an aluminum-silicon alloy.

2. The method according to claim 1 wherein the alumina and silica bearing materials have a low alumina content, and said mix is provided by adding to said alumina and silica bearing material an ore rich in alumina and low in silica.

3. The method according to claim 2 wherein said alumina rich ore is bauxite having not less than 35 wt% alumina and not more than 15 wt.% silica.

4. The method according to claim 1 wherein the alumina and silica bearing material is rich in alumina and has a silica content in the range of 0.1 to 15.0 wt.% and said mix is provided by adding to said material a source of silica.

5. The method according to claim 1 wherein said carbonaceous reducing material is carbon and said mix contains 15 to 30 wt.% carbon.

6. The method according to claim 1 wherein said alumina and silica bearing material contains 25 to 65 wt.% silica and said weight ratio is obtained by preferential removal of silica therefrom.

7. The method according to claim 6 wherein said removal of silica is accomplished by leaching with a solution containing hydrofluoric acid.

8. The method according to claim 1 wherein said alumina and silica bearing material is anorthosite.

9. The method according to claim 1 wherein said alumina and silica bearing material is ground to a size in the range of −14 to −200 mesh (Tyler Series).

10. A method of carbothermically producing an alloy containing aluminum and silicon from an alumina and silica bearing ore wherein said ore contains not more than 35 wt.% alumina and 25 to 65 wt.% silica, the method comprising:

a. grinding said ore to a size in the range of −14 to −200 mesh (Tyler Series);

b. treating said ground ore in an acid solution to remove alkali and alkaline earth metal;

c. adjusting the silica and alumina content of said ore to provide a weight ratio of silica to alumina in the range of 0.5 to 1.1;

d. providing 15 to 30 wt.% carbon to effect reduction of said alumina and said silica; and e. carbothermically reducing alumina and silica content of the mix to produce said aluminum-silicon alloy.

11. The method according to claim 10 wherein said ore is anorthosite.

12. The method according to claim 11 wherein said weight ratio is obtained by adding bauxite.

13. A method of carbothermically producing an aluminum-silicon alloy from anorthosite, the method comprising:

a. grinding said anorthosite to a size in the range of −14 to −200 mesh (Tyler Series);

b. treating said ground anorthosite in an acid solution to remove alkali and alkaline earth metals;

c. adjusting the silica and alumina content of said ore by adding bauxite thereto to provide a weight ratio of silica to alumina in the range of 0.5 to 1.1, said bauxite being ground to a size in the range of −14 to −200 mesh (Tyler Series);

d. providing 15 to 30 wt.% carbon to effect reduction of said alumina and said silica; and e. carbothermically reducing alumina and silica content of the mix to produce said aluminum-silicon alloy.

14. A method of carbothermically producing an alumina-silica alloy from an alumina and silica bearing ore wherein said ore contains 40 to 55 wt.% alumina and 0.1 to 15.0 wt.% silica, the method comprising:

a. grinding said ore to a size in the range of −14 to −200 mesh (Tyler Series);

b. adjusting the silica content of said ore by adding a source of silica thereto to provide a mix having a weight ratio of silica to alumina in the range of 0.5 to 1.1;

c. providing 15 to 30 wt.% carbon to effect reduction of said alumina and said silica; and d. carbothermically reducing alumina and silica content of the mix to produce said aluminum-silicon alloy.

* * * * *